US010608344B2

(12) United States Patent
Paulotto et al.

(10) Patent No.: US 10,608,344 B2
(45) Date of Patent: Mar. 31, 2020

(54) ELECTRONIC DEVICE ANTENNA ARRAYS MOUNTED AGAINST A DIELECTRIC LAYER

(71) Applicant: Apple Inc., Cupertino, CA (US)

(72) Inventors: Simone Paulotto, Redwood City, CA (US); Jennifer M. Edwards, San Francisco, CA (US); Harish Rajagopalan, San Jose, CA (US); Bilgehan Avser, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 154 days.

(21) Appl. No.: 16/002,941

(22) Filed: Jun. 7, 2018

(65) Prior Publication Data

US 2019/0379134 A1 Dec. 12, 2019

(51) Int. Cl.

| | |
|---|---|
| ***H01Q 21/06*** | (2006.01) |
| ***H01Q 5/392*** | (2015.01) |
| ***H01Q 3/26*** | (2006.01) |

(52) U.S. Cl.

CPC ..... *H01Q 21/062* (2013.01); *H01Q 3/2652* (2013.01); *H01Q 5/392* (2015.01); *H01Q 21/065* (2013.01)

(58) Field of Classification Search

CPC ..... H01Q 21/06; H01Q 5/39; H01Q 3/26

USPC ..... 343/700 MS

See application file for complete search history.

(56) References Cited

U.S. PATENT DOCUMENTS

| | | | | |
|---|---|---|---|---|
| 7,986,280 | B2 * | 7/2011 | Semonov | H01Q 1/246 343/795 |
| 8,354,972 | B2 | 1/2013 | Borja et al. | |
| 2017/0302306 | A1 * | 10/2017 | Ouyang | H04B 1/1081 |
| 2018/0090816 | A1 * | 3/2018 | Mow | H01Q 1/243 |

* cited by examiner

*Primary Examiner* — Andrea Lindgren Baltzell
(74) *Attorney, Agent, or Firm* — Treyz Law Group, P.C.; Joseph F. Guihan

(57) ABSTRACT

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antennas may be arranged in a phased antenna array. The phased antenna array may be formed on a dielectric substrate and may include one or more indirectly-fed microstrip dipole antennas. Conductive traces forming dipole antenna resonating elements or parasitic resonating elements for the dipole antennas in the phased antenna array may be embedded within or formed on an upper surface of the dielectric substrate. The phased antenna array may include both dipole antennas and patch antennas. Dipole antennas may be interposed between adjacent patch antennas or formed next to patch antennas.

20 Claims, 10 Drawing Sheets

ELECTRONIC DEVICE ANTENNA ARRAYS MOUNTED AGAINST A DIELECTRIC LAYER

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums and can generation undesirable surface waves at medium interfaces.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antennas may be arranged in a phased antenna array.

The electronic device may include a housing having a dielectric cover layer. The phased antenna array may be formed on a dielectric substrate and may include one or more indirectly-fed microstrip dipole antennas. Conductive traces forming dipole antenna resonating elements or parasitic resonating elements for the dipole antennas in the phased antenna array may be embedded within or formed on an upper surface of the dielectric substrate. The surface of the dielectric substrate may be mounted against an interior surface of the dielectric cover layer (e.g., using a layer of adhesive). The dielectric cover layer may have a dielectric constant and a thickness that is selected so that the dielectric cover layer forms a quarter wave impedance transformer for the phased antenna array at a wavelength of operation of the phased antenna array. When configured in this way, signal attenuation and destructive interference within and below the dielectric cover layer may be minimized. The phased antenna array may convey radio-frequency signals through the dielectric cover layer with satisfactory antenna gain across all angles within the field of view of the phased antenna array.

The phased antenna array may include both dipole antennas and patch antennas. Multiple dipole antennas may be arranged in the phased antenna array with different orientations for covering multiple polarizations. Because the dipole antennas have a relatively small lateral footprint, using dipole antennas may maximize the number of antennas that can fit within the phased antenna array (and thus the overall gain of the array). Dipole antennas may be interposed between adjacent patch antennas or formed next to patch antennas (between the patch antenna and the edge of the dielectric substrate, for example).

DETAILED DESCRIPTION

Figure 1:
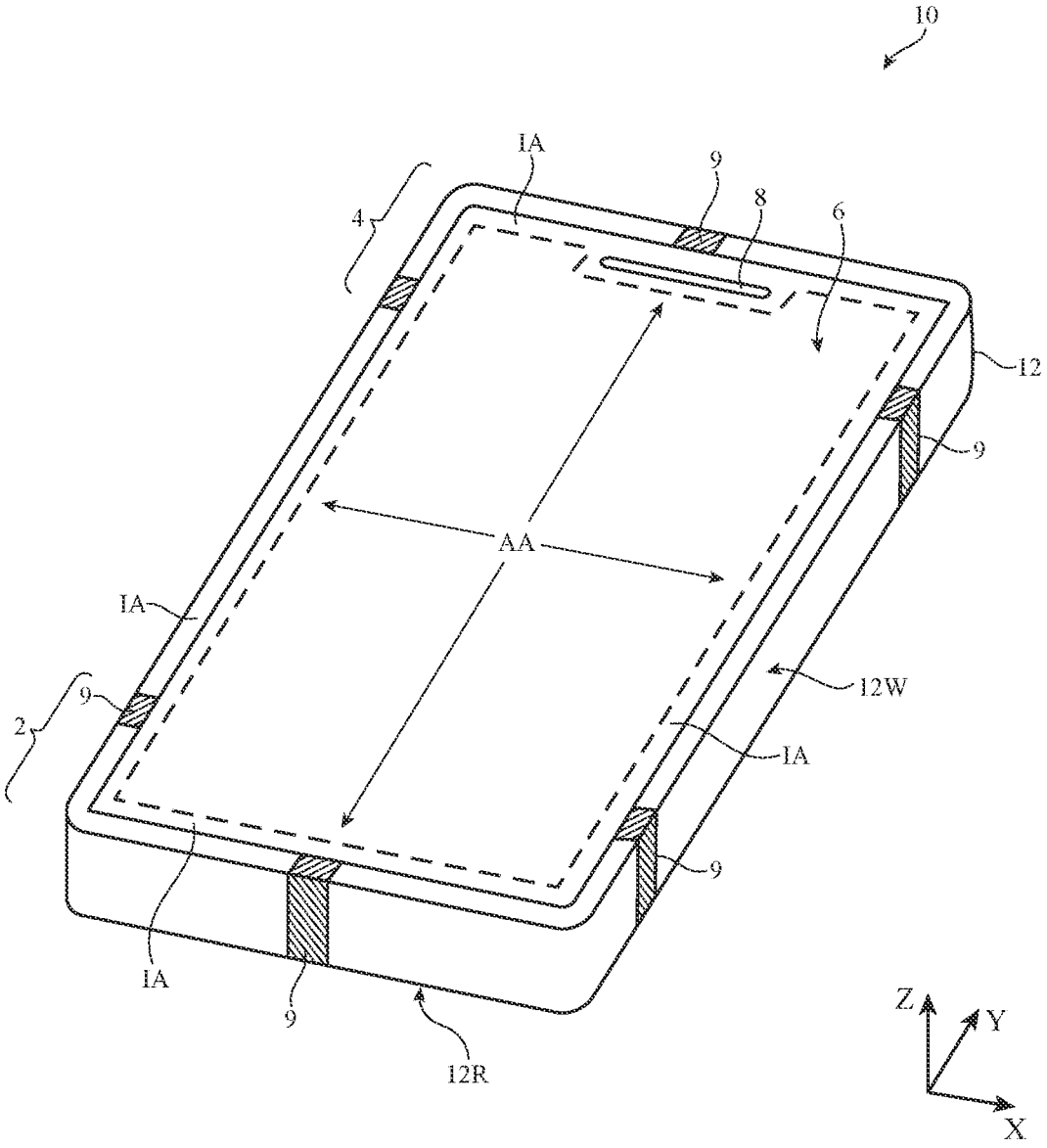
FIG. 1 is a perspective view of an illustrative electronic device in accordance with an embodiment.

Electronic devices such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. While uses of millimeter wave communications may be described herein as examples, centimeter wave communications, EHF communications, or any other types of communications may be similarly used. If desired, electronic devices may also contain wireless communications circuitry for handling satellite navigation system signals, cellular telephone signals, local wireless area network signals, near-field communications, light-based wireless communications, or other wireless communications.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 6. Display 6 may be mounted on the front face of device 10. Display 6 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 6. In configurations in which device 10 and display 6 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 6 (e.g., a cosmetic trim that surrounds all four sides of display 6 and/or that helps hold display 6 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 6 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 6), peripheral conductive housing structures 12W may run around the lip of housing 12 (i.e., peripheral conductive housing structures 12W may cover only the edge of housing 12 that surrounds display 6 and not the rest of the sidewalls of housing 12).

Rear housing wall 12R may lie in a plane that is parallel to display 6. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive structures 12W and/or conductive portions of rear housing wall 12R from view of the user).

Display 6 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 6 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 6 that overlaps inactive area IA may be coated with an opaque masking layer in inactive area IA. The opaque masking layer may have any suitable color.

Display 6 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 8 or a microphone port. Openings may be formed in housing 12 to form communications ports (e.g., an audio jack port, a digital data port, etc.) and/or audio ports for audio components such as a speaker and/or a microphone if desired.

Display 6 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 6, for example.

In regions 2 and 4, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 6, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 2 and 4 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 2 and 4. If desired, the ground plane that is under active area AA of display 6 and/or other metal structures in device 10 may have portions that extend into parts of the ends of device 10 (e.g., the ground may extend towards the dielectric-filled openings in regions 2 and 4), thereby narrowing the slots in regions 2 and 4.

In general, device 10 may include any suitable number of antennas (e.g., one or more, two or more, three or more, four or more, etc.). The antennas in device 10 may be located at opposing first and second ends of an elongated device housing (e.g., ends at regions 2 and 4 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 9, as shown in FIG. 1. The gaps in peripheral conductive housing structures 12W may be filled with dielectric such as polymer, ceramic, glass, air, other dielectric materials, or combinations of these materials. Gaps 9 may divide peripheral conductive housing structures 12W into one or more peripheral conductive segments. There may be, for example, two peripheral conductive segments in peripheral conductive housing structures 12W (e.g., in an arrangement with two of gaps 9), three peripheral conductive segments (e.g., in an arrangement with three of gaps 9), four peripheral conductive segments (e.g., in an arrangement with four of gaps 9), six peripheral conductive segments (e.g., in an arrangement with six gaps 9), etc. The segments of peripheral conductive housing structures 12W that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 9, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 4. A lower antenna may, for example, be formed at the lower end of device 10 in region 2. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc. Two or more antennas in device 10 may be arranged in a phased antenna array for covering millimeter and centimeter wave communications if desired.

In order to provide an end user of device 10 with as large of a display as possible (e.g., to maximize an area of the device used for displaying media, running applications, etc.), it may be desirable to increase the amount of area at the front face of device 10 that is covered by active area AA of display 6. Increasing the size of active area AA may reduce the size of inactive area IA within device 10. This may reduce the area behind display 6 that is available for antennas within device 10. For example, active area AA of display 6 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency.

Figure 2:
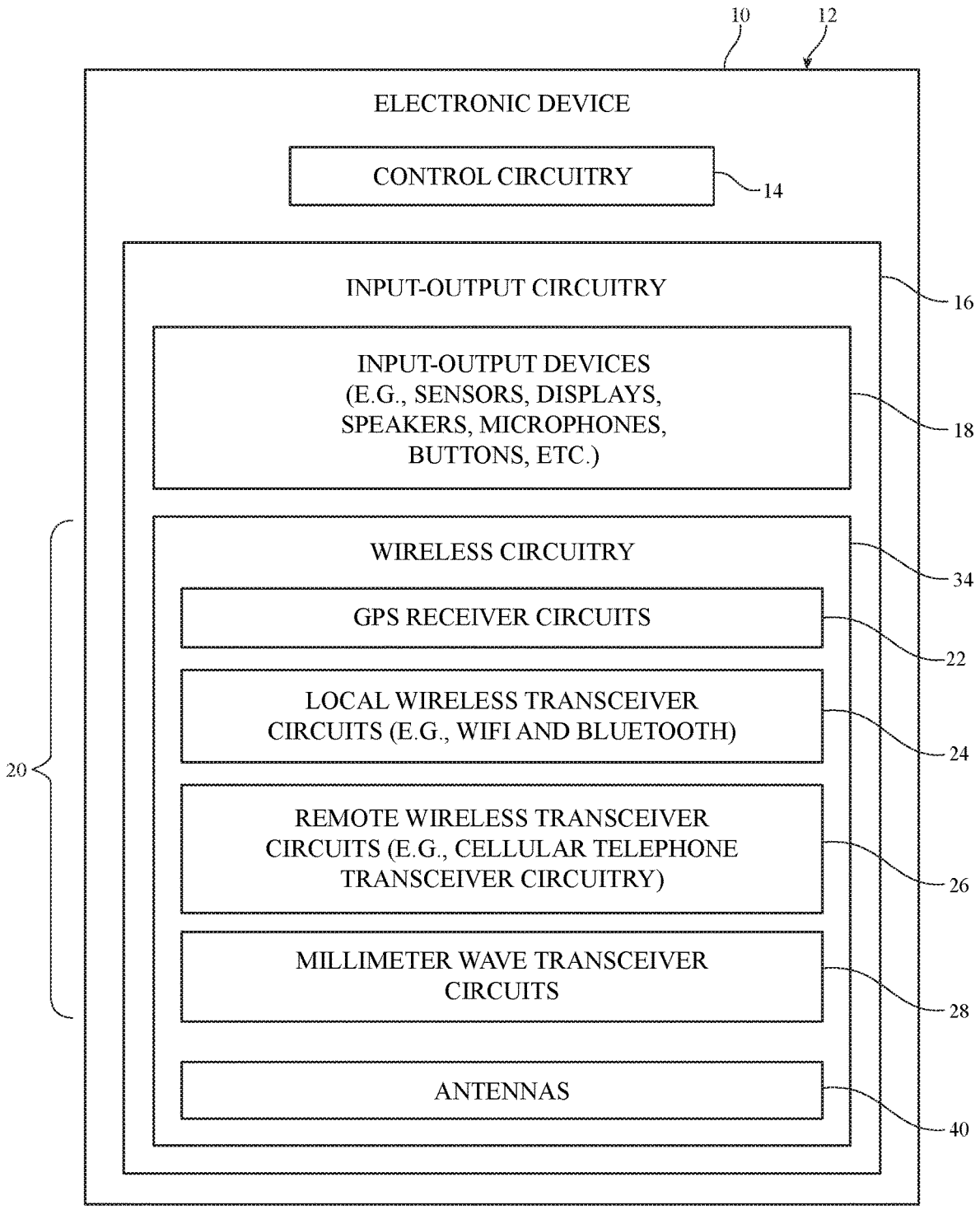
FIG. 2 is a schematic diagram of an illustrative electronic device with wireless communications circuitry in accordance with an embodiment.

FIG. 2 is a schematic diagram showing illustrative components that may be used in an electronic device such as electronic device 10. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other wireless personal area network protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 20 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for Wi-Fi® (IEEE 802.11) communications or other wireless local area network (WLAN) bands and may handle the 2.4 GHz Bluetooth® communications band or other wireless personal area network (WPAN) bands.

Circuitry 34 may use cellular telephone transceiver circuitry 26 for handling wireless communications in frequency ranges such as a low communications band from 600 to 960 MHz, a midband from 1710 to 2170 MHz, a high band from 2300 to 2700 MHz, an ultra-high band from 3400 to 3700 MHz, or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or 5th generation mobile networks or 5th generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., transceiver circuitry 28 may transmit and receive radio-frequency signals in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In Wi-Fi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals that travel (over short distances) between a transmitter and a receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, stacked patch antenna structures, antenna structures having parasitic elements, inverted-F antenna structures, slot antenna structures, planar inverted-F antenna structures, monopoles, dipoles, helical antenna structures, Yagi (Yagi-Uda) antenna structures, surface integrated waveguide structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can be arranged in phased antenna arrays for handling millimeter wave and centimeter wave communications.

Transmission line paths may be used to route antenna signals within device 10. For example, transmission line paths may be used to couple antennas 40 to transceiver circuitry 20. Transmission line paths in device 10 may include coaxial cable paths, microstrip transmission lines, stripline transmission lines, edge-coupled microstrip transmission lines, edge-coupled stripline transmission lines, waveguide structures for conveying signals at millimeter wave frequencies (e.g., coplanar waveguides or grounded coplanar waveguides), transmission lines formed from combinations of transmission lines of these types, etc.

Transmission line paths in device 10 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40 if desired.

In some configurations, antennas 40 may include antenna arrays (e.g., phased antenna arrays to implement beam steering functions). For example, the antennas that are used in handling millimeter wave signals for extremely high frequency wireless transceiver circuits 28 may be implemented as phased antenna arrays. The radiating elements in a phased antenna array for supporting millimeter wave communications may be patch antennas, dipole antennas, Yagi (Yagi-Uda) antennas, or other suitable antenna elements. Transceiver circuitry 28 can be integrated with the phased antenna arrays to form integrated phased antenna array and transceiver circuit modules or packages (sometimes referred to herein as integrated antenna modules or antenna modules) if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased antenna arrays into device 10, each of which is placed in a different location within or on device 10. With this type of arrangement, an unblocked phased antenna array may be switched into use and, once switched into use, the phased antenna array may use beam steering to optimize wireless performance. Similarly, if a phased antenna array does not face or have a line of sight to an external device, another phased antenna array that has line of sight to the external device may be switched into use and that phased antenna array may use beam steering to optimize wireless performance. Configurations in which antennas from one or more different locations in device 10 are operated together may also be used (e.g., to form a phased antenna array, etc.).

Figure 3:
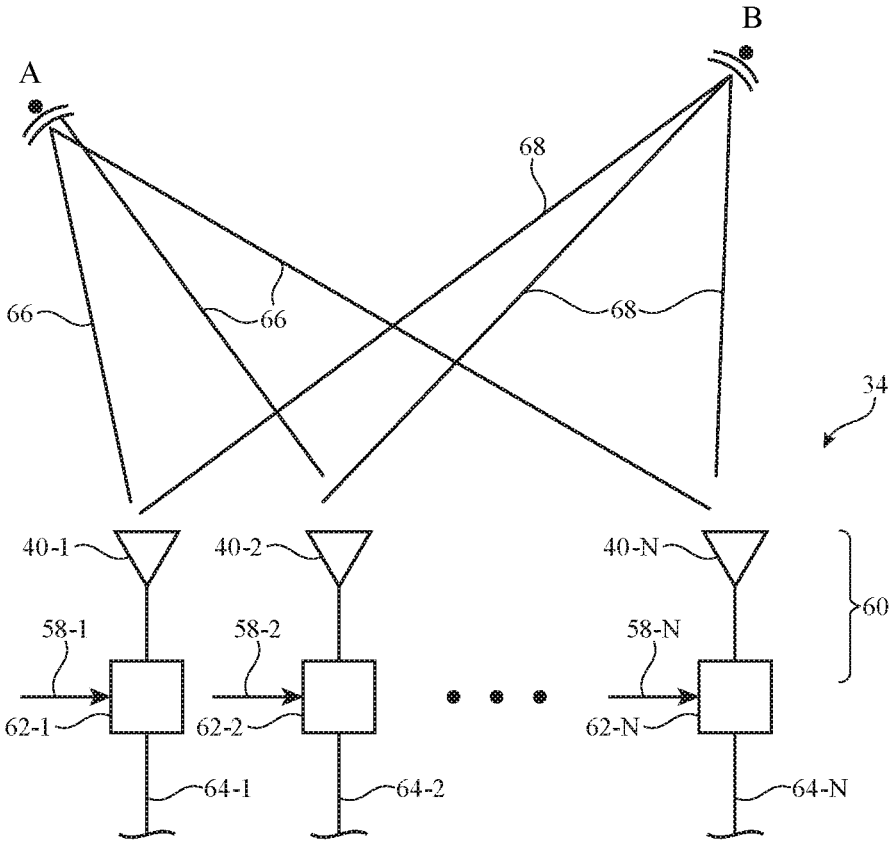
FIG. 3 is a diagram of an illustrative phased antenna array that may be adjusted using control circuitry to direct a beam of signals in accordance with an embodiment.

FIG. 3 shows how antennas 40 on device 10 may be formed in a phased antenna array. As shown in FIG. 3, phased antenna array 60 (sometimes referred to herein as array 60, antenna array 60, or array 60 of antennas 40) may be coupled to signal paths such as transmission line paths 64 (e.g., one or more radio-frequency transmission lines). For example, a first antenna 40-1 in phased antenna array 60 may be coupled to a first transmission line path 64-1, a second antenna 40-2 in phased antenna array 60 may be coupled to a second transmission line path 64-2, an Nth antenna 40-N in phased antenna array 60 may be coupled to an Nth transmission line path 64-N, etc. While antennas 40 are described herein as forming a phased antenna array, the antennas 40 in phased antenna array 60 may sometimes be referred to as collectively forming a single phased array antenna.

Antennas 40 in phased antenna array 60 may be arranged in any desired number of rows and columns or in any other desired pattern (e.g., the antennas need not be arranged in a grid pattern having rows and columns). During signal transmission operations, transmission line paths 64 may be used to supply signals (e.g., radio-frequency signals such as millimeter wave and/or centimeter wave signals) from transceiver circuitry 28 (FIG. 2) to phased antenna array 60 for wireless transmission to external wireless equipment. During signal reception operations, transmission line paths 64 may be used to convey signals received at phased antenna array 60 from external equipment to transceiver circuitry 28 (FIG. 2).

The use of multiple antennas 40 in phased antenna array 60 allows beam steering arrangements to be implemented by controlling the relative phases and magnitudes (amplitudes) of the radio-frequency signals conveyed by the antennas. In the example of FIG. 3, antennas 40 each have a corresponding radio-frequency phase and magnitude controller 62 (e.g., a first phase and magnitude controller 62-1 interposed on transmission line path 64-1 may control phase and magnitude for radio-frequency signals handled by antenna 40-1, a second phase and magnitude controller 62-2 interposed on transmission line path 64-2 may control phase and magnitude for radio-frequency signals handled by antenna 40-2, an Nth phase and magnitude controller 62-N interposed on transmission line path 64-N may control phase and magnitude for radio-frequency signals handled by antenna 40-N, etc.).

Phase and magnitude controllers 62 may each include circuitry for adjusting the phase of the radio-frequency signals on transmission line paths 64 (e.g., phase shifter circuits) and/or circuitry for adjusting the magnitude of the radio-frequency signals on transmission line paths 64 (e.g., power amplifier and/or low noise amplifier circuits). Phase and magnitude controllers 62 may sometimes be referred to collectively herein as beam steering circuitry (e.g., beam steering circuitry that steers the beam of radio-frequency signals transmitted and/or received by phased antenna array 60).

Phase and magnitude controllers 62 may adjust the relative phases and/or magnitudes of the transmitted signals that are provided to each of the antennas in phased antenna array 60 and may adjust the relative phases and/or magnitudes of the received signals that are received by phased antenna array 60 from external equipment. Phase and magnitude controllers 62 may, if desired, include phase detection circuitry for detecting the phases of the received signals that are received by phased antenna array 60 from external equipment. The term "beam" or "signal beam" may be used herein to collectively refer to wireless signals that are transmitted and received by phased antenna array 60 in a particular direction. The term "transmit beam" may sometimes be used herein to refer to wireless radio-frequency signals that are transmitted in a particular direction whereas the term "receive beam" may sometimes be used herein to refer to wireless radio-frequency signals that are received from a particular direction.

If, for example, phase and magnitude controllers 62 are adjusted to produce a first set of phases and/or magnitudes for transmitted millimeter wave signals, the transmitted signals will form a millimeter wave frequency transmit beam as shown by beam 66 of FIG. 3 that is oriented in the direction of point A. If, however, phase and magnitude controllers 62 are adjusted to produce a second set of phases and/or magnitudes for the transmitted millimeter wave signals, the transmitted signals will form a millimeter wave frequency transmit beam as shown by beam 68 that is oriented in the direction of point B. Similarly, if phase and magnitude controllers 62 are adjusted to produce the first set of phases and/or magnitudes, wireless signals (e.g., millimeter wave signals in a millimeter wave frequency receive beam) may be received from the direction of point A as shown by beam 66. If phase and magnitude controllers 62 are adjusted to produce the second set of phases and/or magnitudes, signals may be received from the direction of point B, as shown by beam 68.

Each phase and magnitude controller 62 may be controlled to produce a desired phase and/or magnitude based on a corresponding control signal 58 received from control circuitry 14 of FIG. 2 or other control circuitry in device 10 (e.g., the phase and/or magnitude provided by phase and magnitude controller 62-1 may be controlled using control signal 58-1, the phase and/or magnitude provided by phase and magnitude controller 62-2 may be controlled using control signal 58-2, etc.). If desired, control circuitry 14 may actively adjust control signals 58 in real time to steer the transmit or receive beam in different desired directions over time. Phase and magnitude controllers 62 may provide information identifying the phase of received signals to control circuitry 14 if desired.

When performing millimeter or centimeter wave communications, radio-frequency signals are conveyed over a line of sight path between phased antenna array 60 and external equipment. If the external equipment is located at location A of FIG. 3, phase and magnitude controllers 62 may be adjusted to steer the signal beam towards direction A. If the external equipment is located at location B, phase and magnitude controllers 62 may be adjusted to steer the signal beam towards direction B. In the example of FIG. 3, beam steering is shown as being performed over a single degree of freedom for the sake of simplicity (e.g., towards the left and right on the page of FIG. 3). However, in practice, the beam is steered over two or more degrees of freedom (e.g., in three dimensions, into and out of the page and to the left and right on the page of FIG. 3).

Figure 4:
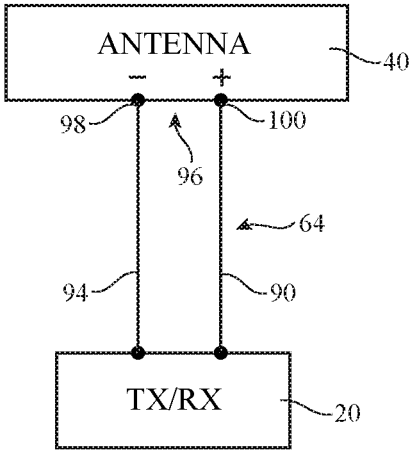
FIG. 4 is a schematic diagram of illustrative wireless communications circuitry in accordance with an embodiment.

A schematic diagram of an antenna 40 that may be formed in phased antenna array 60 (e.g., as antenna 40-1, 40-2, 40-3, and/or 40-N in phased antenna array 60 of FIG. 3) is shown in FIG. 4. As shown in FIG. 4, antenna 40 may be coupled to transceiver circuitry 20 (e.g., millimeter wave transceiver circuitry 28 of FIG. 2). Transceiver circuitry 20 may be coupled to antenna feed 96 of antenna 40 using transmission line path 64 (sometimes referred to herein as radio-frequency transmission line 64). Antenna feed 96 may include a positive antenna feed terminal such as positive antenna feed terminal 98 and may include a ground antenna feed terminal such as ground antenna feed terminal 100. Transmission line path 64 may include a positive signal conductor such as signal conductor 94 that is coupled to terminal 98 and a ground conductor such as ground conductor 90 that is coupled to terminal 100.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas 40P. An illustrative patch antenna 40P that may be used in phased antenna array 60 of FIG. 3 is shown in FIG. 5.

Figure 5:
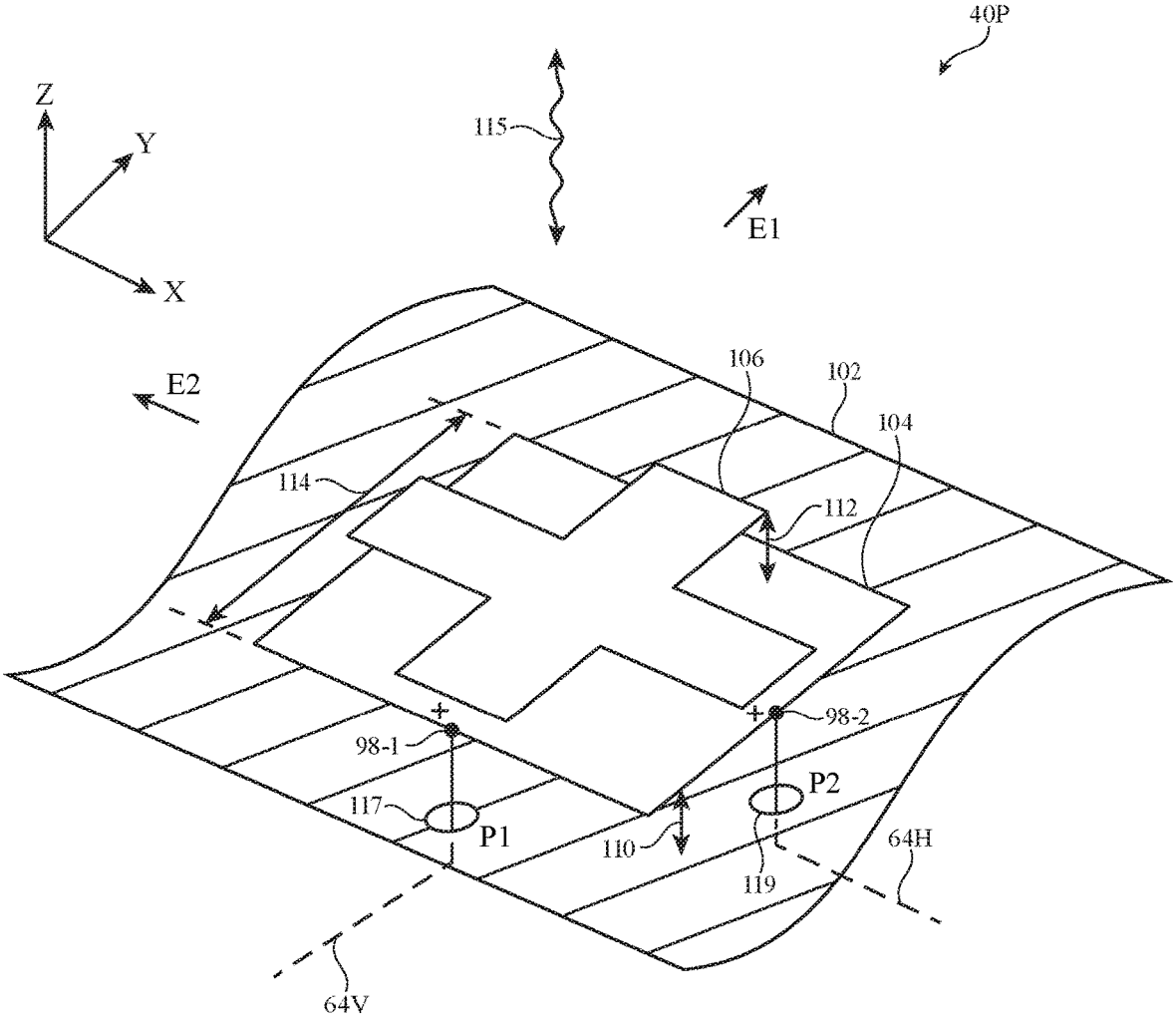
FIG. 5 is a perspective view of an illustrative patch antenna having a parasitic element in accordance with an embodiment.

As shown in FIG. 5, patch antenna 40P may have a patch antenna resonating element 104 that is separated from and parallel to a ground plane such as antenna ground plane 102 (sometimes referred to herein as antenna ground 102, ground structures 102, or ground 102). Patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground plane 102 may lie within a plane that is parallel to the plane of patch element 104. Patch element 104 and ground plane 102 may therefore lie in separate parallel planes that are separated by a distance 110. Patch element 104 and ground plane 102 may be formed from conductive traces patterned on a dielectric substrate such as a rigid or flexible printed circuit board substrate, metal foil, stamped sheet metal, electronic device housing structures, or any other desired conductive structures.

The length of the sides of patch element 104 may be selected so that patch antenna 40P resonates at a desired operating frequency. For example, the sides of patch element 104 may each have a length 114 that is approximately equal to half of the wavelength of the signals conveyed by patch antenna 40P (e.g., the effective wavelength given the dielectric properties of the materials surrounding patch element 104). In one suitable arrangement, length 114 may be between 0.8 mm and 1.2 mm (e.g., approximately 1.1 mm) for covering a millimeter wave frequency band between 57 GHz and 70 GHz or between 1.6 mm and 2.2 mm (e.g., approximately 1.85 mm) for covering a millimeter wave frequency band between 37 GHz and 41 GHz, as just two examples.

The example of FIG. 5 is merely illustrative. Patch element 104 may have a square shape in which all of the sides of patch element 104 are the same length or may have a different rectangular shape. Patch element 104 may be formed in other shapes having any desired number of straight and/or curved edges. If desired, patch element 104 and ground plane 102 may have different shapes and relative orientations.

To enhance the polarizations handled by patch antenna 40P, antenna 40P may be provided with multiple feeds. As shown in FIG. 5, patch antenna 40P may have a first feed at antenna port P1 that is coupled to a first transmission line path 64 such as transmission line path 64V and a second feed at antenna port P2 that is coupled to a second transmission line path 64 such as transmission line path 64H. The first antenna feed may have a first ground feed terminal coupled to ground plane 102 (not shown in FIG. 5 for the sake of clarity) and a first positive feed terminal 98-1 coupled to patch element 104. The second antenna feed may have a second ground feed terminal coupled to ground plane 102 (not shown in FIG. 5 for the sake of clarity) and a second positive feed terminal 98-2 on patch element 104.

Holes or openings such as openings 117 and 119 may be formed in ground plane 102. Transmission line path 64V may include a vertical conductor (e.g., a conductive through-via, conductive pin, metal pillar, solder bump, combinations of these, or other vertical conductive interconnect structures) that extends through hole 117 to positive antenna feed terminal 98-1 on patch element 104. Transmission line path 64H may include a vertical conductor that extends through hole 119 to positive antenna feed terminal 98-2 on patch element 104. This example is merely illustrative and, if desired, other transmission line structures may be used (e.g., coaxial cable structures, stripline transmission line structures, etc.).

When using the first antenna feed associated with port P1, patch antenna 40P may transmit and/or receive radio-frequency signals having a first polarization (e.g., the electric field E1 of antenna signals 115 associated with port P1 may be oriented parallel to the Y-axis in FIG. 5). When using the antenna feed associated with port P2, patch antenna 40P may transmit and/or receive radio-frequency signals having a second polarization (e.g., the electric field E2 of antenna signals 115 associated with port P2 may be oriented parallel to the X-axis of FIG. 5 so that the polarizations associated with ports P1 and P2 are orthogonal to each other).

One of ports P1 and P2 may be used at a given time so that patch antenna 40P operates as a single-polarization antenna or both ports may be operated at the same time so that antenna 40P operates with other polarizations (e.g., as a dual-polarization antenna, a circularly-polarized antenna, an elliptically-polarized antenna, etc.). If desired, the active port may be changed over time so that patch antenna 40P can switch between covering vertical or horizontal polarizations at a given time. Ports P1 and P2 may be coupled to different phase and magnitude controllers 62 (FIG. 3) or may both be coupled to the same phase and magnitude controller 62. If desired, ports P1 and P2 may both be operated with the same phase and magnitude at a given time (e.g., when patch antenna 40P acts as a dual-polarization antenna). If desired, the phases and magnitudes of radio-frequency signals conveyed over ports P1 and P2 may be controlled separately and varied over time so that patch antenna 40P exhibits other polarizations (e.g., circular or elliptical polarizations).

If care is not taken, antennas 40 such as dual-polarization patch antennas of the type shown in FIG. 5 may have insufficient bandwidth for covering an entirety of a communications band of interest (e.g., a communications band at frequencies greater than 10 GHz). If desired, patch antenna 40P may include one or more parasitic antenna resonating elements that serve to broaden the bandwidth of the antenna.

As shown in FIG. 5, a bandwidth-widening parasitic antenna resonating element such as parasitic antenna resonating element 106 may be formed from conductive structures located at a distance 112 over patch element 104. Parasitic antenna resonating element 106 may sometimes be referred to herein as parasitic resonating element 106, parasitic antenna element 106, parasitic element 106, parasitic patch 106, parasitic conductor 106, parasitic structure 106, parasitic 106, or patch 106. Parasitic element 106 is not directly fed, whereas patch element 104 is directly fed via transmission line paths 64V and 64H and positive antenna feed terminals 98-1 and 98-2.

At least some or an entirety of parasitic element 106 may overlap patch element 104. In the example of FIG. 5, parasitic element 106 has a cross or "X" shape. In order to form the cross shape, parasitic element 106 may include notches or slots formed by removing conductive material from the corners of a square or rectangular metal patch. Parasitic element 106 may have a rectangular (e.g., square) outline or footprint. Removing conductive material from parasitic element 106 to form a cross shape may serve to adjust the impedance of patch element 104 so that the impedance of patch element 104 is matched to both transmission line paths 64V and 64H, for example. The example of FIG. 5 is merely illustrative. If desired, parasitic element 106 may have other shapes or orientations.

If desired, patch antenna 40P of FIG. 5 may be formed on a dielectric substrate (not shown in FIG. 5 for the sake of clarity). The dielectric substrate may be, for example, a rigid or printed circuit board or other dielectric substrate. The dielectric substrate may include multiple stacked dielectric layers (e.g., multiple layers of printed circuit board substrate such as multiple layers of fiberglass-filled epoxy, multiple layers of ceramic substrate, etc.). Ground plane 102, patch element 104, and parasitic element 106 may be formed on different layers of the dielectric substrate if desired.

When configured in this way, patch antenna 40P may cover a relatively wide millimeter wave communications band of interest such as a frequency band between 57 GHz and 71 GHz or a frequency band between 37 GHz and 41 GHz. The example of FIG. 5 is merely illustrative. Parasitic element 106 may be omitted if desired. Antennas 40 such as patch antenna 40P may have any desired number of antenna feeds.

In practice, patch antennas such as patch antenna 40P of FIG. 5 exhibit relatively uniform radiation patterns over all azimuthal angles relative to the normal axis of patch element 104. However, patch antenna 40P is relatively large in size. This limits the total number of patch antennas 40P per unit area that can fit within phased antenna array 60. As the gain of phased antenna array 60 is proportional to the number of antennas in the array, forming all of antennas 40 in phased antenna array 60 as patch antennas 40P can limit the overall gain of phased antenna array 60. In order to maximize the number of antennas that can fit within phased antenna array 60 (and thus the overall gain of the array), some or all of the antennas in phased antenna array 60 may be implemented using other types of antennas having smaller lateral footprints than patch antenna 40P. For example, some or all of the antennas 40 in phased antenna array may be implemented using dipole antenna structures. Antennas 40 that are implemented using dipole antenna structures may sometimes be referred to herein as dipole antennas 40D (e.g., microstrip dipole antennas 40D). An illustrative dipole antenna 40D that may be used in phased antenna array 60 of FIG. 3 is shown in FIG. 6.

Figure 6:
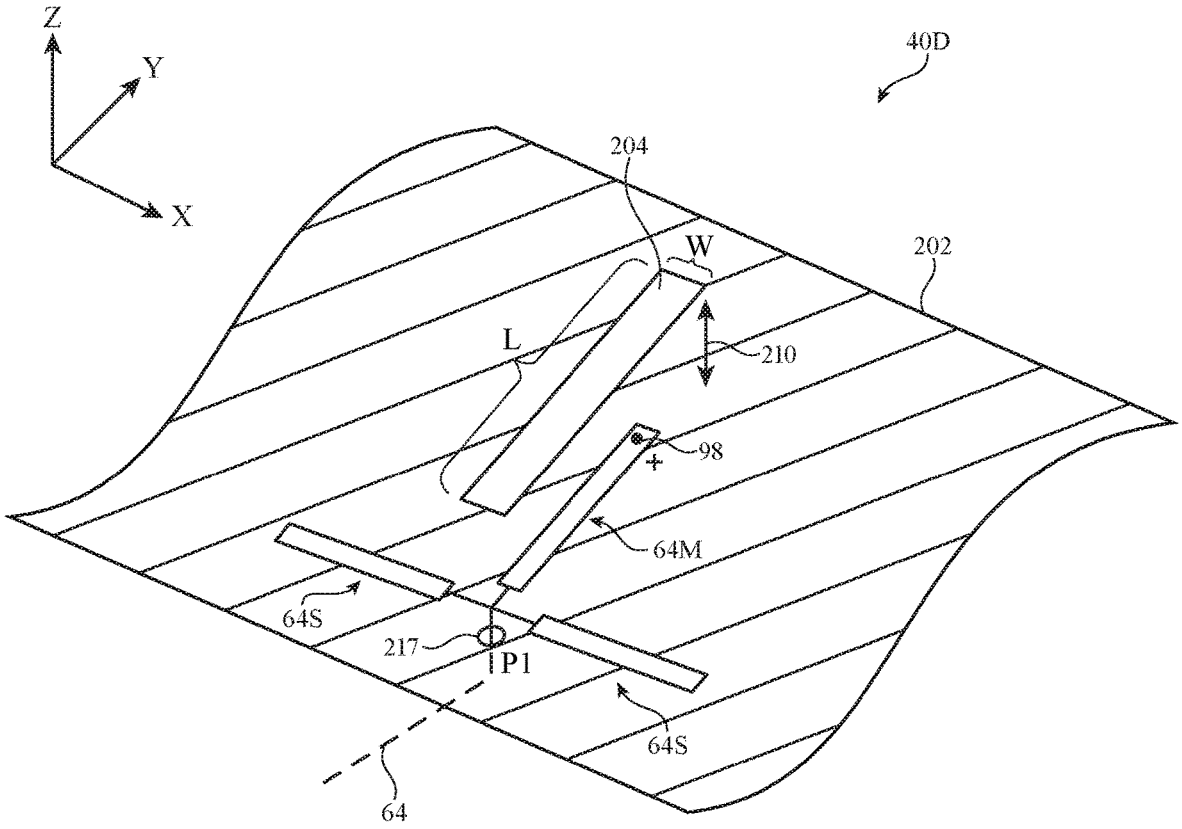
FIG. 6 is a perspective view of an illustrative dipole antenna in accordance with an embodiment.

As shown in FIG. 6, dipole antenna 40D may have a dipole antenna resonating element 204 that is separated from and extends parallel to antenna ground plane 202 (sometimes referred to herein as antenna ground 202). Dipole antenna resonating element 204 may lie within a plane such as the X-Y plane of FIG. 6 (e.g., the lateral surface area of element 204 may lie in the X-Y plane). Dipole antenna resonating element 204 may sometimes be referred to herein as dipole element 204, dipole resonating element 204, dipole radiating element 204, microstrip dipole element 204, microstrip dipole antenna resonating element 204, antenna resonating element 204, or resonating element 204. Ground plane 202 may lie within a plane that is parallel to the plane of dipole antenna resonating element 204. Dipole antenna resonating element 204 and ground plane 202 may therefore lie in separate parallel planes that are separated by a distance 210. Dipole antenna resonating element 204 and ground plane 202 may be formed from conductive traces patterned on a dielectric substrate such as a rigid or flexible printed circuit board substrate, metal foil, stamped sheet metal, electronic device housing structures, or any other desired conductive structures.

Dipole antenna resonating element 204 may have a width W and a length L (e.g., dipole antenna resonating element 204 may be a conductive patch having length L and width W). Length L of dipole antenna resonating element 204 may extend along a longitudinal axis (e.g., parallel to the Y-axis in FIG. 6) such that length L is longer than width W. In this way, dipole antenna resonating element 204 and ground plane 202 (dipole antenna 40D) may form a microstrip dipole antenna having a signal conductor formed from dipole antenna resonating element 204. The length of dipole antenna resonating element 204 may be selected so that dipole antenna 40D resonates at a desired operating frequency. For example, length L of antenna resonating element 204 may be approximately equal to (e.g., within 5% of) half of the wavelength of the signals conveyed by dipole antenna 40D or may be approximately equal to (e.g., within 5% of) a quarter of the wavelength of the signals conveyed by dipole antenna 40D (e.g., an effective wavelength given the dielectric properties of the materials surrounding dipole antenna resonating element 204). In one suitable arrangement, length L may be between 0.8 mm and 1.2 mm (e.g., approximately 1.1 mm) for covering a millimeter wave frequency band between 57 GHz and 70 GHz or between 1.6 mm and 2.2 mm (e.g., approximately 1.85 mm) for covering a millimeter wave frequency band between 37 GHz and 41 GHz, as just two examples.

Dipole antenna 40D in FIG. 6 has an antenna feed at antenna port P1 that is coupled to a transmission line such as transmission line 64. Transmission line 64 for feeding dipole antenna 40D in FIG. 6 may include a main transmission line path 64M and transmission line stubs 64S. Transmission line stubs 64S may serve to match the impedance of dipole antenna 40D to transmission line 64 (e.g., without using separate impedance matching components such as bulky surface mount capacitors or inductors). The location, length, and width of transmission line stubs 64S may, for example, be selected to perform desired impedance matching. The example of FIG. 6 is merely illustrative. Transmission line stubs 64S may have the same lengths or different lengths. In one embodiment, transmission line stubs 64S may be symmetrical about main transmission line path 64M (e.g., a first transmission line stub may extend in the positive X-direction and have a given length whereas a second transmission line stub extends in the negative X-direction and has the same given length). Transmission line stubs 64S may be shorted to main transmission line path 64M or an open circuit may be formed between transmission line stubs 64S and main transmission line path 64M.

When configured in this way, main transmission line path 64M, transmission line stubs 64S, and ground plane 202 may form microstrip transmission line structures. Main transmission line path 64M and stubs 64S may be formed from conductive traces (or other desired conductive layers) on a printed circuit board or other desired dielectric substrate. The conductive traces used to form main transmission line path 64M and stubs 64S may lie within a plane that is parallel to the plane of dipole antenna resonating element 204 and ground plane 202 (e.g., some or all of main transmission line path 64M may be interposed between dipole antenna resonating element 204 and ground plane 202). A hole or opening such as opening 217 may be formed in ground plane 202. Transmission line 64 may include a vertical conductor (e.g., a conductive through-via, conductive pin, metal pillar, solder bump, combinations of these, or other vertical conductive interconnect structures) that extends through hole 217.

The antenna feed for dipole antenna 40D may include a ground antenna feed terminal coupled to ground plane 202 (not shown in FIG. 6 for the sake of clarity) and a positive antenna feed terminal 98 on main transmission line feed path 64M (sometimes referred to as feed element 64M) that is indirectly coupled to dipole antenna resonating element 204. In other words, dipole antenna resonating element 204 is not directly fed (i.e., is indirectly fed) by main transmission line path 64M. Main transmission line path 64M may excite dipole antenna resonating element 204 via near-field electromagnetic coupling to radiate at millimeter wave frequencies. In this way, dipole antenna resonating element 204 is indirectly fed by transmission line structures formed from main transmission line path 64M, ground plane 202, and stubs 64S. Main transmission line path 64M may sometimes be referred to herein as an indirect antenna feeding element, an indirect antenna feeding transmission line structure, an indirect antenna feeding microstrip transmission line, or a feed transmission line.

The example in FIG. 6 in which dipole antenna 40D is fed using microstrip transmission line structures formed from main transmission line path 64M and tuning stubs 64S is merely illustrative. Tuning stubs 64S may be omitted if desired. Main transmission line path 64M may be implemented as a stripline transmission line path or may be implemented using any other desired transmission line structures or other conductive structures (e.g., conductive patches, segments of conductive traces, etc.).

Figure 7:
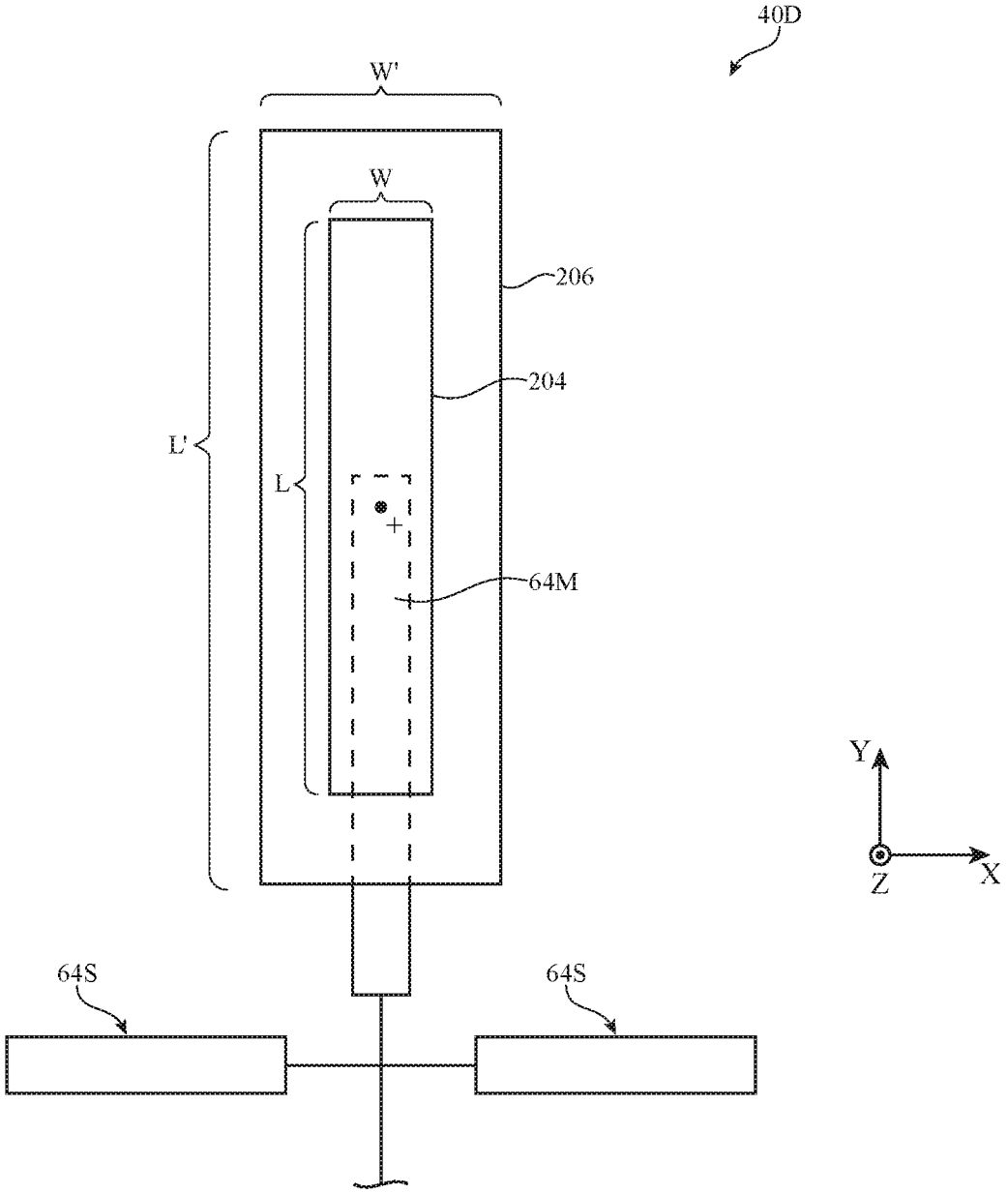
FIG. 7 is a top view of an illustrative dipole antenna having a parasitic element in accordance with an embodiment.

If care is not taken, antennas 40 such as dipole antenna 40D of the type shown in FIG. 6 may have insufficient bandwidth for covering an entirety of a communications band of interest (e.g., a communications band at frequencies greater than 10 GHz). If desired, dipole antenna 40D in FIG. 6 may therefore also include one or more parasitic antenna resonating elements that serve to broaden the bandwidth of dipole antenna 40D. FIG. 7 is a top view of an illustrative dipole antenna that includes a bandwidth-widening parasitic antenna resonating element.

As shown in FIG. 7, dipole antenna 40D may include a parasitic antenna resonating element such as parasitic antenna resonating element 206. Parasitic antenna resonating element 206 may be formed from conductive structures (e.g., conductive traces) located over dipole antenna resonating element 204. Parasitic antenna resonating element 206 may sometimes be referred to herein as parasitic resonating element 206, parasitic antenna element 206, parasitic element 206, parasitic patch 206, parasitic conductor 206, parasitic structure 206, parasitic 206, or patch 206. Parasitic element 206 is not directly fed (e.g., parasitic element may be coupled to dipole antenna resonating element 204 by near-field electromagnetic coupling).

At least some or an entirety of parasitic element 206 may overlap antenna resonating element 204. Antenna resonating element 204 is formed over and overlaps at least some of main transmission line path 64M. Transmission line stubs 64S extend symmetrically from either side of main transmission line path 64M. In the example of FIG. 7, parasitic element 206 has a larger area than antenna resonating element 204 and completely overlaps antenna resonating element 204. Parasitic element 206 may have a width W' that is longer than the width W of dipole antenna resonating element 204 and/or a length L' that is longer than the length L of dipole antenna resonating element 204. Selecting a length L' and width W' for parasitic element 206 such that parasitic element 206 is larger than and overlaps dipole antenna resonating element 204 may serve to increase the bandwidth of antenna 40. Length L' may, for example, be less than 50% longer than L, less than 30% longer than L, less than 20% longer than L, less than 10% longer than L, less than 5% longer than L, etc. Similarly, width W' may be less than 50% longer than W, less than 30% longer than W, less than 20% longer than W, less than 10% longer than W, less than 5% longer than W, etc. This example is merely illustrative, and parasitic element 206 may have other shapes, orientations, or sizes.

If desired, antenna 40D of FIG. 7 may be formed on a dielectric substrate (not shown in FIGS. 6 and 7 for the sake of clarity). The dielectric substrate may be, for example, a rigid or printed circuit board or other dielectric substrate. The dielectric substrate may include multiple stacked dielectric layers (e.g., multiple layers of printed circuit board substrate such as multiple layers of fiberglass-filled epoxy, multiple layers of ceramic substrate, etc.). Ground plane 202, main transmission line path 64, dipole antenna resonating element 204, and parasitic element 206 may be formed on different layers of the dielectric substrate if desired.

Figure 8:
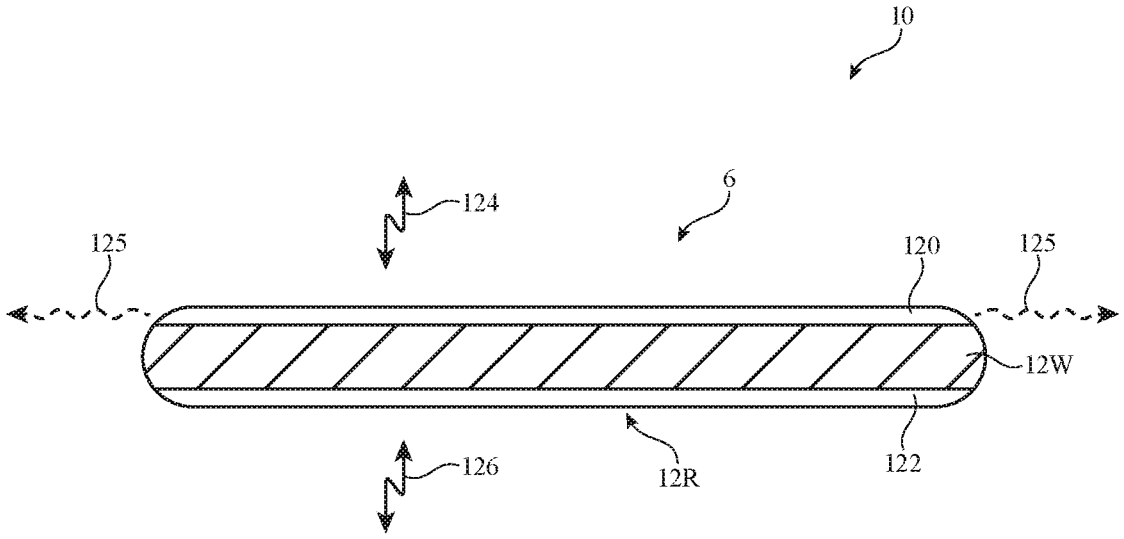
FIG. 8 is a side view of an illustrative electronic device having dielectric cover layers at front and rear faces in accordance with an embodiment.

FIG. 8 is a cross-sectional side view of device 10 showing how phased antenna array 60 (FIG. 3) may convey radio-frequency signals through a dielectric cover layer for device 10. The plane of the page of FIG. 8 may, for example, lie in the Y-Z plane of FIG. 1.

As shown in FIG. 8, peripheral conductive housing structures 12W may extend around the periphery of device 10. Peripheral conductive housing structures 12W may extend across the height (thickness) of device 10 from a first dielectric cover layer such as dielectric cover layer 120 to a second dielectric cover layer such as dielectric cover layer 122. Dielectric cover layers 120 and 122 may sometimes be referred to herein as dielectric covers, dielectric layers, dielectric walls, or dielectric housing walls. If desired, dielectric cover layer 120 may extend across the entire lateral surface area of device 10 and may form a first (front) face of device 10. Dielectric cover layer 122 may extend across the entire lateral surface area of device 10 and may form a second (rear) face of device 10.

In the example of FIG. 8, dielectric cover layer 122 forms a part of rear housing wall 12R for device 10 whereas dielectric cover layer 120 forms a part of display 6 (e.g., a display cover layer for display 6). Active circuitry in display 6 may emit light through dielectric cover layer 120 and may receive touch or force input from a user through dielectric cover layer 120. Dielectric cover layer 122 may form a thin dielectric layer or coating under a conductive portion of rear housing wall 12R (e.g., a conductive backplate or other conductive layer that extends across substantially all of the lateral area of device 10). Dielectric cover layers 120 and 122 may be formed from any desired dielectric materials such as glass, plastic, sapphire, ceramic, etc.

Conductive structures such as peripheral conductive housing structures 12W may block electromagnetic energy conveyed by phased antenna arrays in device 10 such as phased antenna array 60 of FIG. 3. In order to allow radio-frequency signals to be conveyed with wireless equipment external to device 10, phased antenna arrays such as phased antenna array 60 may be mounted behind dielectric cover layer 120 and/or dielectric cover layer 122.

When mounted behind dielectric cover layer 120, phased antenna array 60 may transmit and receive wireless signals (e.g., wireless signals at millimeter and centimeter wave frequencies) such as radio-frequency signals 124 through dielectric cover layer 120. When mounted behind dielectric cover layer 122, phased antenna array 60 may transmit and receive wireless signals such as radio-frequency signals 126 through dielectric cover layer 120.

In practice, radio-frequency signals at millimeter and centimeter wave frequencies such as radio-frequency signals 124 and 126 may be subject to substantial attenuation, particularly through relatively dense mediums such as dielectric cover layers 120 and 122. The radio-frequency signals may also be subject to destructive interference due to reflections within dielectric cover layers 120 and 122 and may generate undesirable surface waves at the interfaces between dielectric cover layers 120 and 122 and the interior of device 10. For example, radio-frequency signals conveyed by a phased antenna array 60 mounted behind dielectric cover layer 120 may generate surface waves at the interior surface of dielectric cover layer 120. If care is not taken, the surface waves may propagate laterally outward (e.g., along the interior surface of dielectric cover layer 120) and may escape out the sides of device 10, as shown by arrows 125. Surface waves such as these may reduce the overall antenna efficiency for the phased antenna array, may generate undesirable interference with external equipment, and may subject the user to undesirable radio-frequency energy absorption, for example. Similar surface waves can also be generated at the interior surface of dielectric cover layer 122.

Figure 9:
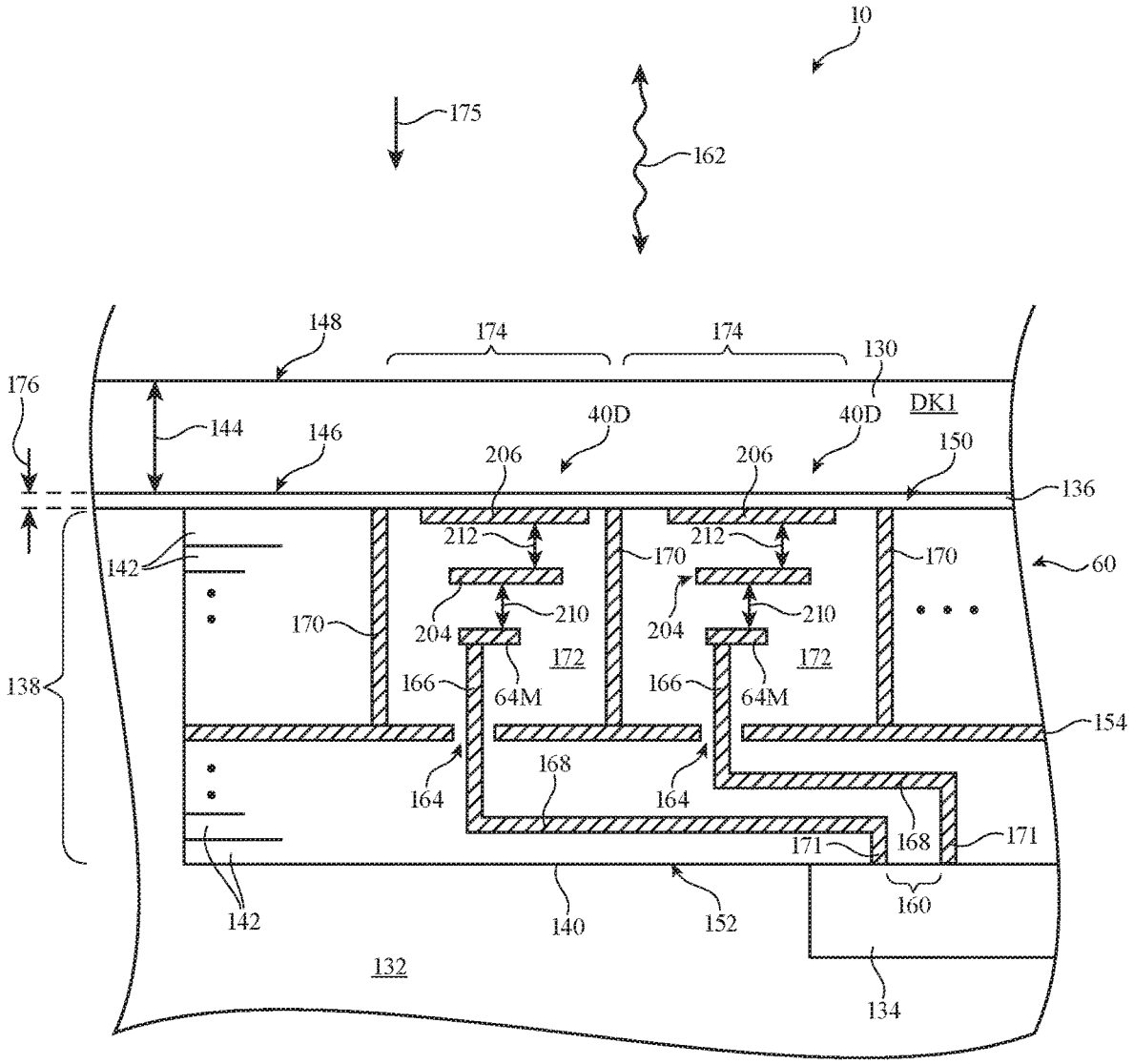
FIG. 9 is a cross-sectional side view of an illustrative phased antenna array that may be mounted against a dielectric cover layer in an electronic device in accordance with an embodiment.

FIG. 9 is a cross-sectional side view of device 10 showing how phased antenna array 60 may be implemented within device 10 to mitigate these issues. As shown in FIG. 9, phased antenna array 60 may be formed on a dielectric substrate such as substrate 140 mounted within interior 132 of device 10 and against dielectric cover layer 130. Phased antenna array 60 may include multiple antennas 40 (e.g., dipole antennas 40D as shown in FIGS. 6 and 7 and/or patch antennas 40P as shown in FIG. 5) arranged in an array of rows and columns (e.g., a one or two-dimensional array) or in other patterns. In the example of FIG. 9, two dipole antennas 40D are shown in array 60. Dielectric cover layer 130 may form a dielectric rear wall for device 10 (e.g., dielectric cover layer 130 of FIG. 9 may form dielectric cover layer 122 of FIG. 8) or may form a display cover layer for device 10 (e.g., dielectric cover layer 130 of FIG. 9 may form dielectric cover layer 120 of FIG. 8), as examples. Dielectric cover layer 130 may be formed from a visually opaque material or may be provided with pigment so that dielectric cover layer 130 is visually opaque if desired.

Substrate 140 may be, for example, a rigid or flexible printed circuit board or other dielectric substrate. Substrate 140 may include multiple stacked dielectric layers 142 (e.g., multiple layers of printed circuit board substrate such as multiple layers of fiberglass-filled epoxy) or may include a single dielectric layer. Substrate 140 may include any desired dielectric materials such as epoxy, plastic, ceramic, glass, foam, or other materials. Antennas 40 in phased array antenna 60 may be mounted at a surface of substrate 140 or may be partially or completely embedded within substrate 140 (e.g., within a single layer of substrate 140 or within multiple layers of substrate 140).

In the example of FIG. 9, dipole antennas 40D in phased antenna array 60 include a ground plane (e.g., ground plane 202 of FIG. 6) and dipole antenna resonating elements 204 that are formed from conductive traces embedded within layers 142 of substrate 140. The ground plane for phased antenna array 60 may be formed from conductive traces 154 within substrate 140, for example. Dipole antennas 40D in phased antenna array 60 may include parasitic elements 206 (e.g., parasitic elements 206 as shown in FIG. 7) that are formed from conductive traces at surface 150 of substrate 140. For example, parasitic elements 206 may be formed from conductive traces on the top-most layer 142 of substrate 140. In another suitable arrangement, one or more layers 142 may be interposed between parasitic elements 206 and dielectric cover layer 130. In yet another suitable arrangement, parasitic elements 206 may be omitted and dipole antenna resonating elements 204 may be formed from conductive traces at surface 150 of substrate 140 (e.g., dipole antenna resonating element 204 may be in direct contact with adhesive layer 136 or interior surface 146 of dielectric cover layer 130).

Surface 150 of substrate 140 may be mounted against (e.g., attached to) interior surface 146 of dielectric cover layer 130. For example, substrate 140 may be mounted to dielectric cover layer 130 using an adhesive layer such as adhesive layer 136. This is merely illustrative. If desired, substrate 140 may be affixed to dielectric cover layer 130 using other adhesives, screws, pins, springs, conductive housing structures, etc. Substrate 140 need not be affixed to dielectric cover layer 130 if desired (e.g., substrate 140 may be in direct contact with dielectric cover layer 130 or may be pressed against dielectric cover layer 130 without being affixed to dielectric cover layer 130). Parasitic elements 206 in phased antenna array 60 may be in direct contact with interior surface 146 of dielectric cover layer 130 (e.g., in scenarios where adhesive layer 136 is omitted or where adhesive layer 136 has openings that align with parasitic elements 206) or may be coupled to interior surface 146 by adhesive layer 136 (e.g., parasitic elements 206 may be in direct contact with adhesive layer 136).

Phased array antenna 60 and substrate 140 may sometimes be referred to herein collectively as antenna module 138. If desired, transceiver circuitry 134 (e.g., transceiver circuitry 28 of FIG. 2) or other transceiver circuits may be mounted to antenna module 138 (e.g., at surface 152 of substrate 140 or embedded within substrate 140). While FIG. 9 shows two dipole antennas 40D, this is merely illustrative. In general, any desired number of antennas may be formed in phased antenna array 60. The example of FIG. 9 in which antennas 40 are dipole antennas is merely illustrative. Antenna module 138 may include patch antenna resonating elements (e.g., as shown in FIG. 5), Yagi antenna resonating elements, slot antenna resonating elements, any other desired antenna resonating elements of antennas of any desired type, or a combination of these. If desired, phased antenna array 60 may include different types of antennas for covering different frequencies. For example, phased antenna array 60 may include a set of dipole antennas 40D for covering a first frequency band and a set of patch antennas 40P (FIG. 5) for covering a second frequency band.

If desired, a conductive layer (e.g., a conductive portion of rear housing wall 12R when dielectric cover layer 130 forms dielectric cover layer 122 of FIG. 8) may also be formed on interior surface 146 of dielectric cover layer 130. In these scenarios, the conductive layer may provide structural and mechanical support for device 10 and may form a part of the antenna ground plane for device 10. The conductive layer may have an opening that is aligned with phased antenna array 60 and/or antenna module 138 (e.g., to allow radio-frequency signals 162 to be conveyed through the conductive layer).

Conductive traces 154 may sometimes be referred to herein as ground traces 154, ground plane 154, antenna ground 154, or ground plane traces 154. The layers 142 in substrate 140 between ground traces 154 and dielectric cover layer 130 may sometimes be referred to herein as antenna layers 142. The layers in substrate 140 between ground traces 154 and surface 152 of substrate 140 may sometimes be referred to herein as transmission line layers. The antenna layers may be used to support dipole resonating elements 204, parasitic elements 206, and feed structures for the dipole antennas 40D in phased antenna array 60. The transmission line layers may be used to support additional transmission line structures for phased antenna array 60.

Transceiver circuitry 134 may include transceiver ports 160. Each transceiver port 160 may be coupled to a respective antenna 40 over one or more corresponding transmission line paths 64 (e.g., transmission line path 64 in FIG. 6). Transceiver ports 160 may include conductive contact pads, solder balls, microbumps, conductive pins, conductive pillars, conductive sockets, conductive clips, welds, conductive adhesive, conductive wires, interface circuits, or any other desired conductive interconnect structures.

Transmission line paths for antennas 40 such as dipole antennas 40D may be embedded within layers 142 of substrate 140. The transmission line paths may include conductive traces 168 (e.g., conductive traces on one or more dielectric layers 142 within substrate 140). Conductive traces 168 may form signal conductor 94 and/or ground conductor 90 (FIG. 4) of one, more than one, or all of transmission lines 64 for the antennas 40 in phased antenna array 60. If desired, additional grounded traces within the transmission line layers of substrate 140 and/or portions of ground traces 154 may form ground conductor 90 (FIG. 4) for one or more transmission lines 64.

Conductive traces 168 may be coupled to microstrip transmission line structures that form main transmission line path 64M for dipole antennas 40D (FIG. 6) over vertical conductive structures 166. Vertical conductive structures 166 may extend through a portion of the transmission line layers of substrate 140, holes or openings 164 in ground traces 154 (e.g., holes such as hole 217 of FIG. 6), and the antenna layers in substrate 140 to main transmission line paths 64M. Transmission line stubs 64S (FIG. 6) may be coplanar with main transmission line paths 64M in FIG. 9. Main transmission line paths 64M in FIG. 9 indirectly feed dipole antenna resonating elements 204 of dipole antennas 40D. Conductive traces 168 may also be coupled to transceiver ports 160 over vertical conductive structures 171. Vertical conductive structures 171 may extend through a portion of the transmission line layers in substrate 140 to transceiver ports 160. Vertical conductive structures 166 and 171 may include conductive through-vias, metal pillars, metal wires, conductive pins, or any other desired vertical conductive interconnects.

If care is not taken, radio-frequency signals transmitted by antennas 40 in phased antenna array 60 may reflect off of interior surface 146, thereby limiting the gain of phased antenna array 60 in some directions. Mounting conductive structures from antennas 40 (e.g., dipole antenna resonating elements 204 or parasitic elements 206 from dipole antennas 40D) directly against interior surface 146 (e.g., either through adhesive layer 136 or in direct contact with interior surface 146) may serve to minimize these reflections, thereby optimizing antenna gain for phased antenna array 60 in all directions. Adhesive layer 136 may have a selected thickness 176 that is sufficiently small so as to minimize these reflections while still allowing for a satisfactory adhesion between dielectric cover layer 130 and substrate 140. As an example, thickness 176 may be between 300 microns and 400 microns, between 200 microns and 500 microns, between 325 microns and 375 microns, between 100 microns and 600 microns, etc.

The distances between main transmission line paths 64M and dipole antenna resonating elements 204 (e.g., distances 210) and the distances between dipole antenna resonating elements 204 and parasitic resonating elements 206 (e.g., distances 212) may also be selected to minimize reflections off of interior surface 146 and to help match the impedance of antennas 40D to the free space impedance external to device 10. Distances 210 and 212 may each be greater than 300 microns, greater than 600 microns, greater than 900 microns, less than 1000 microns, less than 750 microns, less than 500 microns, less than 250 microns, or any other desired distance.

In practice, the radio-frequency signals transmitted by phased antenna array 60 may reflect within dielectric cover layer 130 (e.g., at interior surface 146 and/or exterior surface 148 of dielectric cover layer 130). Such reflections may, for example, be due to the difference in dielectric constant between dielectric cover layer 130 and the space external to device 10 as well as the difference in dielectric constant between substrate 140 and dielectric cover layer 130. If care is not taken, the reflected signals may destructively interfere with each other and/or with the transmitted signals within dielectric cover layer 130. This may lead to a deterioration in antenna gain for phased antenna array 60 over some angles, for example.

In order to mitigate these destructive interference effects, the dielectric constant DK1 of dielectric cover layer 130 and thickness 144 of dielectric cover layer 130 may be selected to optimize matching of the antenna impedance for phased antenna array 60 to the free space impedance external to device 10 and mitigate destructive interference within dielectric cover layer 130.

As examples, dielectric cover layer 130 may be formed of a material having a dielectric constant between about 3.0 and 10.0 (e.g., between 4.0 and 9.0, between 5.0 and 8.0, between 5.5 and 7.0, between 5.0 and 7.0, etc.). In one particular arrangement, dielectric cover layer 130 may be formed from glass, ceramic, or other dielectric materials having a dielectric constant of about 6.0. Thickness 144 of dielectric cover layer 130 may be selected to be between 0.15 and 0.25 times the effective wavelength of operation of phased antenna array 60 in the material used to form dielectric cover layer 130, between 0.17 and 0.23 times the effective wavelength, between 0.12 and 0.28 times the effective wavelength, between 0.19 and 0.21 times the effective wavelength, between 0.15 and 0.30 times the effective wavelength, etc. In practice, thickness 144 may be between 0.8 mm and 1.0 mm, between 0.85 mm and 0.95 mm, or between 0.7 mm and 1.1 mm, as examples. In this way, dielectric cover layer 130 may serve as a quarter wave transformer between phased antenna array 60 and the exterior of device 10. Adhesive layer 136 may be formed from dielectric materials having a dielectric constant that is less than dielectric constant DK1 of dielectric cover layer 130.

Each dipole antenna 40D may optionally be separated from the other dipole antennas 40D in phased antenna array 60 by vertical conductive structures such as conductive through vias 170 (sometimes referred to herein as conductive vias 170). Sets or fences of conductive vias 170 may laterally surround each dipole antenna 40D in phased antenna array 60. Conductive vias 170 may extend through substrate 140 from surface 150 to ground traces 156. Conductive landing pads (not shown in FIG. 9 for the sake of clarity) may be used to secure conductive vias 170 to each layer 142 as the conductive vias pass through substrate 140.

By shorting conductive vias 170 to ground traces 154, conductive vias 170 may be held at the same ground or reference potential as ground traces 154.

As shown in FIG. 9, the dipole antenna resonating element 204 and parasitic element 206 of each dipole antenna 40D in phased antenna 60 may be mounted within a corresponding volume 172 (sometimes referred to herein as cavity 172). The edges of volume 172 for each dipole antenna 40D may be defined by conductive vias 170, ground traces 154, and dielectric cover layer 130 (e.g., volume 172 for each dipole antenna 40D may be enclosed by conductive vias 170, ground traces 154, and dielectric cover layer 130). In this way, conductive vias 170 and ground traces 154 may form a conductive cavity for each dipole antenna 40D in phased antenna array 60. Conductive vias 170 may also serve to isolate the dipole antennas 40D in phased antenna array 60 from each other if desired (e.g., to minimize electromagnetic cross-coupling between the antennas). This example is merely illustrative and conductive vias 170 may be omitted if desired. In another suitable arrangement, conductive vias 170 may surround the lateral periphery of phased antenna array 60 without separating individual antennas within phased antenna array 60 (e.g., a conductive cavity defined by fences of conductive vias 170 and ground traces 156 may laterally surround all of phased antenna array 60).

The narrow width W of dipole antennas 40D (as shown in FIGS. 6 and 7) may allow a greater number of dipole antennas 40D to fit in a unit volume of phased antenna array 60 than patch antennas 40P (FIG. 5). In practice, dipole antennas 40D operate with only a single linear polarization. If desired, multiple dipole antennas 40D may be arranged in phased antenna array 60 with different orientations for covering multiple polarizations. If desired, both dipole antennas 40D and patch antennas 40P may be formed in phased antenna array 60 (e.g., for covering different frequencies, polarizations, and/or radiation pattern envelopes with satisfactory gain and antenna efficiency).

Figure 10:
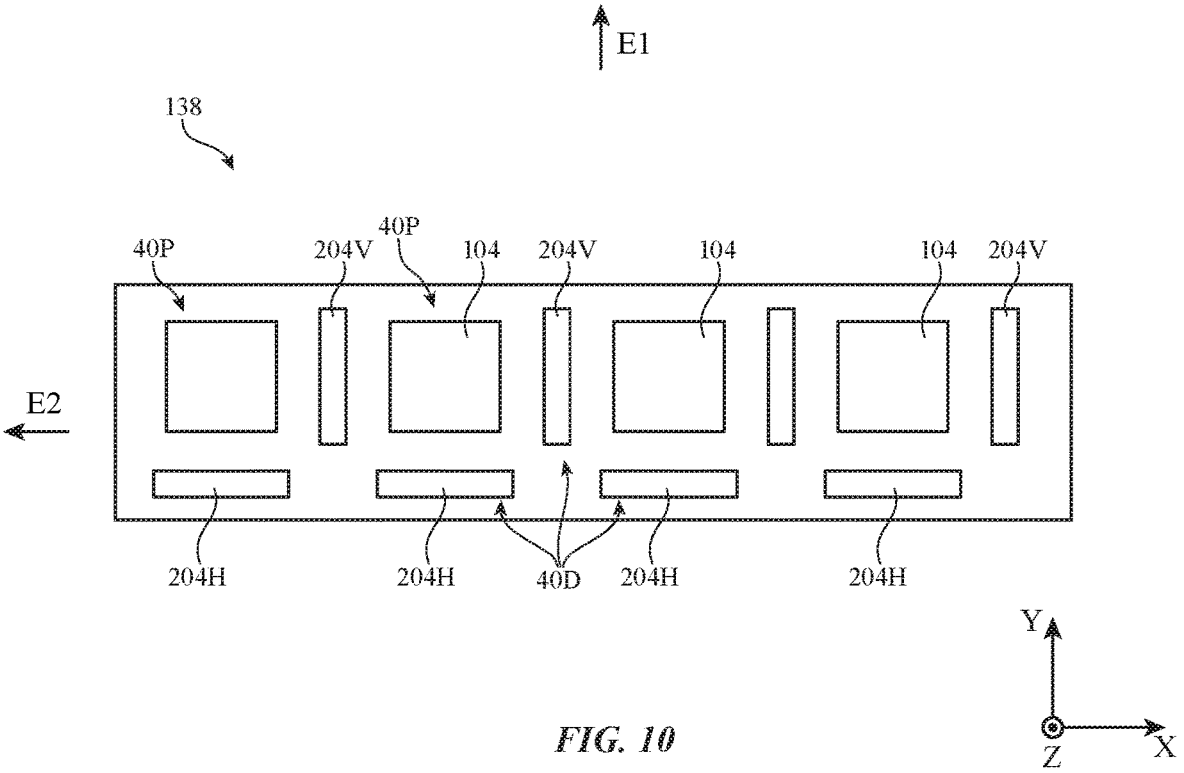
FIG. 10 is a top view of an illustrative antenna module having dipole antennas and patch antennas in accordance with an embodiment.

FIG. 10 shows one example of how phased antenna array 60 may include both dipole antennas 40D and patch antennas 40P. As shown in FIG. 10, antenna module 138 includes a set of patch antennas 40P each having a corresponding patch antenna resonating element 104. Each patch antenna resonating element may have first and second antenna feeds. When using the first antenna feed (e.g., port P1 in FIG. 5), antennas 40P may transmit and/or receive radio-frequency signals having a first polarization. For example, the electric field of the radio-frequency signals conveyed using the first antenna feed may be oriented parallel to electric field E1 in FIG. 10 (parallel to the Y-axis). When using the second antenna feed (e.g., port P2 in FIG. 5), antennas 40P may transmit and/or receive radio-frequency signals having a second polarization. For example, the electric field of the radio-frequency signals conveyed using the second antenna feed may be oriented parallel to electric field E2 in FIG. 10 (parallel to the X-axis).

Antenna module 138 in FIG. 10 also includes first and second sets of dipole antennas 40D having dipole antenna resonating elements. The first set of the dipole antennas 40D have dipole antenna resonating elements 204V with longitudinal axes oriented parallel to the Y-axis. Each dipole antenna resonating element 204V may be used to convey radio-frequency signals having an electric field oriented parallel to electric field E1 in FIG. 10 (e.g., with the same polarization as the radio-frequency signals conveyed using the first antenna feed of patch antennas 40P). The second set of dipole antennas 40D have dipole antenna resonating elements 204H with longitudinal axes oriented parallel to the X-axis. Each dipole antenna resonating element 204H may be used to convey radio-frequency signals having an electric field oriented parallel to electric field E2 in FIG. 10 (e.g., with the same polarization as the radio-frequency signals conveyed using the second antenna feed of patch antennas 40P). In the example of FIG. 10, each antenna resonating element 204V is interposed between respective patch antenna resonating elements 104 and each antenna resonating element 204H is formed below a respective patch antenna resonating element 104. In this way, a greater number of antennas 40 may fit within antenna module 138 than in scenarios where only patch antennas 40P are used. In scenarios where dipole antennas 40D and patch antennas 40P cover the same frequencies, the increase in total number of antennas per unit volume on antenna module 138 may increase the gain of phased antenna array 60 for both polarizations, for example.

If desired, patch antennas 40P and dipole antennas 40D may be used to cover different frequency bands. For example, patch antennas 40P may be used to cover a first millimeter wave frequency band between 37 GHz and 41 GHz, whereas dipole antennas 40D may be used to cover a second millimeter wave frequency band between 28 GHz and 31 GHz. In this way, phased antenna array 60 may cover two frequency bands using the same lateral area as an array that includes only patch antennas 40P. This may eliminate the need to form a separate antenna array for covering other frequency bands in device 10, thereby optimizing space consumption within electronic device 10.

In the example of FIG. 10, dipole antennas 40D and phased patch antennas 40P are used to form a single phased antenna array 60. Alternatively, patch antennas 40P may form a first phased antenna array whereas dipole antennas 40D form a second phased antenna array that is controlled independently of the first phased antenna array. The example of FIG. 10 is merely illustrative. In general, any desired number of dipole antennas 40D and patch antennas 40P may be arranged in any desired pattern within antenna module 138. Patch antennas 40P may be replaced with other types of antennas if desired.

The foregoing is merely illustrative and various modifications can be made to the described embodiments. The foregoing embodiments may be implemented individually or in any combination.

What is claimed is:

1. An electronic device comprising:

a dielectric cover layer;

a dielectric substrate having a surface that is mounted against the dielectric cover layer; and a phased antenna array on the dielectric substrate, wherein the phased antenna array comprises a dipole antenna and the dipole antenna is configured to transmit radio-frequency signals at a frequency between 10 GHz and 300 GHz through the dielectric cover layer.

2. The electronic device defined in claim 1, wherein the dipole antenna comprises a ground plane and a dipole antenna resonating element formed from planar conductive traces on the dielectric substrate, the planar conductive traces being interposed between the dielectric cover layer and the ground plane.

3. The electronic device defined in claim 2, wherein the dipole antenna comprises a feed element that is interposed between the dipole antenna resonating element and the ground plane and that is configured to indirectly feed the dipole antenna resonating element.

4. The electronic device defined in claim 3, wherein the feed element comprises additional planar conductive traces interposed between the conductive traces and the ground plane.

5. The electronic device defined in claim 4, wherein the dipole antenna further comprises a parasitic element interposed between the dipole antenna resonating element and the dielectric cover layer.

6. The electronic device defined in claim 5, further comprising:

an adhesive layer that attaches the surface of the dielectric substrate to the dielectric cover layer, wherein the parasitic element is in direct contact with the adhesive layer.

7. The electronic device defined in claim 4, wherein the dielectric cover layer is configured to form a quarter wave impedance transformer between the phased antenna array and an exterior of the electronic device at the frequency.

8. The electronic device defined in claim 3, wherein the dipole antenna further comprises transmission line stubs coupled to the feed element.

9. The electronic device defined in claim 8, further comprising:

a radio-frequency transceiver; and a radio-frequency transmission line coupled to the radio-frequency transceiver, wherein the radio-frequency transmission line has a signal conductor that is coupled to the feed element through a conductive via extending through at least some of the dielectric substrate and through an opening in the ground plane.

10. The electronic device defined in claim 1, wherein the electronic device has first and second faces and further comprises:

a display having a display cover layer and pixel circuitry that emits light through the display cover layer, wherein the display cover layer forms the first face of the electronic device and the dielectric cover layer forms the second face of the electronic device.

11. The electronic device defined in claim 10, wherein the dielectric cover layer comprises material selected from the group consisting of: glass and ceramic.

12. The electronic device defined in claim 1, further comprising:

a display having pixel circuitry, wherein the pixel circuitry is configured to emit light through the dielectric cover layer.

13. The electronic device defined in claim 1, wherein the phased antenna array further comprises:

a first patch antenna that is configured to transmit radio-frequency signals at an additional frequency through the dielectric cover layer, wherein the additional frequency is between 10 GHz and 300 GHz and is different than the frequency of the radio-frequency signals transmitted by the dipole antenna.

14. The electronic device defined in claim 13, wherein the phased antenna array further comprises:

a second patch antenna that is configured to transmit radio-frequency signals at the additional frequency through the dielectric cover layer, wherein the dipole antenna is interposed between the first and second patch antennas.

15. The electronic device defined in claim 14, wherein the dipole antenna is a first dipole antenna and the phased antenna array further comprises:

a second dipole antenna positioned below the first patch antenna, wherein the first dipole antenna extends along a first axis and the second dipole antenna extends along a second axis that is perpendicular to the first axis.

16. An electronic device comprising:

a dielectric cover layer;

a dielectric substrate; and an indirectly-fed microstrip dipole antenna on the dielectric substrate that is configured to convey radio-frequency signals at a frequency between 10 GHz and 300 GHz through the dielectric cover layer.

17. The electronic device defined in claim 16, wherein the electronic device has first and second faces and further comprises:

a housing having a rear housing wall formed from the dielectric cover layer; and a display in the housing having a display cover layer and pixel circuitry that emits light through the display cover layer, wherein the display cover layer forms the first face of the electronic device and the dielectric cover layer forms the second face of the electronic device.

18. The electronic device defined in claim 16, further comprising:

a display having pixel circuitry, wherein the pixel circuitry is configured to emit light through the dielectric cover layer.

19. An electronic device having first and second faces, comprising:

a housing having a dielectric rear housing wall that forms the first face of the electronic device;

a display in the housing having a display cover layer and pixel circuitry that emits light through the display cover layer, wherein the display cover layer forms the second face of the electronic device;

a dielectric substrate mounted to the dielectric rear housing wall; and a phased antenna array on the dielectric substrate, wherein the phased antenna array comprises a dipole antenna and a patch antenna and the phased antenna array is configured to convey radio-frequency signals at a frequency between 10 GHz and 300 GHz through the dielectric rear housing wall.

20. The electronic device defined in claim 19, further comprising:

a conductive layer on a surface of the dielectric rear housing wall, wherein the conductive layer has an opening aligned with the phased antenna array.

* * * * *